US010767922B2

(12) United States Patent
Chen et al.

(10) Patent No.: US 10,767,922 B2
(45) Date of Patent: Sep. 8, 2020

(54) INTEGRATED NITROGEN REMOVAL IN THE PRODUCTION OF LIQUEFIED NATURAL GAS USING INTERMEDIATE FEED GAS SEPARATION

(71) Applicant: AIR PRODUCTS AND CHEMICALS, INC., Allentown, PA (US)

(72) Inventors: Fei Chen, Whitehouse Station, NJ (US); Yang Liu, Springfield, NJ (US); Gowri Krishnamurthy, Sellersville, PA (US); Christopher Michael Ott, Macungie, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 162 days.

(21) Appl. No.: 15/626,301

(22) Filed: Jun. 19, 2017

(65) Prior Publication Data

US 2017/0284737 A1 Oct. 5, 2017

Related U.S. Application Data

(62) Division of application No. 14/260,678, filed on Apr. 24, 2014, now abandoned.

(51) Int. Cl.
*F25J 3/00* (2006.01)
*F25J 1/00* (2006.01)
(Continued)

(52) U.S. Cl.
CPC ..... *F25J 3/0257* (2013.01); *F25J 1/004* (2013.01); *F25J 1/0022* (2013.01); *F25J 1/0042* (2013.01);
(Continued)

(58) Field of Classification Search
CPC ..... F25J 1/0022; F25J 1/0025; F25J 3/0209; F25J 3/0257; F25J 3/0233; F25J 2205/04;
(Continued)

(56) References Cited

U.S. PATENT DOCUMENTS 3,596,473 A 8/1971 Streich
3,721,099 A 3/1973 Forg et al.
(Continued)

FOREIGN PATENT DOCUMENTS

DE 102009015766 A1 10/2010
DE 102011109234 A1 2/2013
(Continued)

OTHER PUBLICATIONS

Amonymous, "Nitrogen Rejection Unit (NRU) Configurations", Published Sep. 21, 2012, IP.com Prior art database Technical disclosure, IP.com No. 000222164.
(Continued)

*Primary Examiner* — Keith M Raymond
(74) *Attorney, Agent, or Firm* — Amy Carr-Trexler

(57) ABSTRACT

A method and apparatus for liquefying a natural gas feed stream and removing nitrogen therefrom to produce a nitrogen-depleted LNG product, in which a natural gas feed stream is fed into the warm end of a main heat exchanger, cooled and at least partially liquefied, withdrawn from an intermediate location of the main heat exchanger and separated to form a nitrogen-enriched natural gas vapor stream and a nitrogen-depleted natural gas liquid stream, the liquid and vapor streams being reintroduced into an intermediate location of the main heat exchanger and further cooled in parallel to form a first LNG stream and a first at least partially liquefied nitrogen-enriched natural gas stream, respectively.

5 Claims, 7 Drawing Sheets

(51) Int. Cl.
*F25J 3/02* (2006.01)
*F25J 3/06* (2006.01)
*F25J 1/02* (2006.01)

(52) U.S. Cl.
CPC ..... *F25J 1/0055* (2013.01); *F25J 1/0212* (2013.01); *F25J 1/0238* (2013.01); *F25J 3/0209* (2013.01); *F25J 3/0233* (2013.01); *F25J 3/061* (2013.01); *F25J 3/066* (2013.01); *F25J 3/0635* (2013.01); *F25J 2200/02* (2013.01); *F25J 2200/40* (2013.01); *F25J 2200/70* (2013.01); *F25J 2200/76* (2013.01); *F25J 2205/04* (2013.01); *F25J 2215/04* (2013.01); *F25J 2230/08* (2013.01); *F25J 2240/30* (2013.01); *F25J 2245/90* (2013.01); *F25J 2270/18* (2013.01); *F25J 2270/66* (2013.01); *F25J 2290/62* (2013.01)

(58) Field of Classification Search
CPC .. F25J 2200/70; F25J 2270/60; F25J 2245/42; F25J 2245/90; F25J 2220/44; Y10S 62/927
See application file for complete search history.

(56) References Cited

U.S. PATENT DOCUMENTS

| | | | | |
|---|---|---|---|---|
| 3,747,359 | A * | 7/1973 | Streich | F25J 1/0212 62/623 |
| 4,225,329 | A * | 9/1980 | Bailey | F25J 1/0022 62/623 |
| 4,411,677 | A | 10/1983 | Pervier et al. | |
| 4,504,295 | A | 3/1985 | Ott et al. | |
| 4,878,932 | A | 11/1989 | Phade et al. | |
| 6,192,705 | B1 | 2/2001 | Kimble | |
| 6,199,403 | B1 | 3/2001 | Cole et al. | |
| 6,401,486 | B1 | 6/2002 | Lee et al. | |
| 6,837,071 | B2 | 1/2005 | Oakey | |
| 7,520,143 | B2 | 4/2009 | Spilsbury | |
| 8,522,574 | B2 | 9/2013 | Crawford et al. | |
| 2002/0194866 | A1 | 12/2002 | Oakey | |
| 2003/0177786 | A1 | 9/2003 | O'Brien | |
| 2004/0231359 | A1 * | 11/2004 | Brostow | C10L 3/10 62/623 |
| 2007/0157663 | A1 | 7/2007 | Mak et al. | |
| 2010/0077796 | A1 | 4/2010 | Gadre et al. | |
| 2011/0041389 | A1 * | 2/2011 | Bauer | C10L 3/10 44/458 |
| 2011/0226009 | A1 | 9/2011 | Paradowski et al. | |
| 2011/0289963 | A1 | 12/2011 | Price | |
| 2012/0019883 | A1 | 1/2012 | Chae et al. | |
| 2012/0285196 | A1 | 11/2012 | Flinn et al. | |
| 2014/0345319 | A1 | 11/2014 | Corte Real Santos | |
| 2015/0135767 | A1 | 5/2015 | Currence et al. | |

FOREIGN PATENT DOCUMENTS

| | | |
|---|---|---|
| GB | 2297825 A | 8/1996 |
| JP | 2002528693 | 9/2002 |
| JP | 2009504838 | 2/2009 |
| JP | 2013036676 | 2/2013 |
| WO | 2009137168 | 11/2009 |
| WO | 2010040935 | 4/2010 |
| WO | 2013087569 | 6/2013 |
| WO | 2013087570 | 6/2013 |

OTHER PUBLICATIONS

Vovard, Sylvain, Nitrogen Removal on LNG Plant—Select the Optimum Scheme, Gas Processors Association—Europe.
Spring Conference 2011, May 25-27, Impurities in Gas Processing—How to remove what you don't want, Copenhagen, Gas Processors Association—Europe.
"Coalbed Gas Gathering and Transportation and Processing" (edited by Wang Hongxia, China Petrochemical Press, Jun. 2013, pp. 88-95, Chapter 4 section 3 "III. Liquefaction Process".

* cited by examiner

INTEGRATED NITROGEN REMOVAL IN THE PRODUCTION OF LIQUEFIED NATURAL GAS USING INTERMEDIATE FEED GAS SEPARATION

BACKGROUND

The present invention relates to a method for liquefying a natural gas feed stream and removing nitrogen therefrom to produce a nitrogen-depleted, liquefied natural gas (LNG) product. The present invention also relates to an apparatus (such as for example a natural gas liquefaction plant or other form of processing facility) for liquefying a natural gas feed stream and removing nitrogen therefrom to produce a nitrogen-depleted LNG product.

In processes for liquefying natural gas it is often desirable or necessary, for example due to purity and/or recovery requirements, to remove nitrogen from the feed stream while minimizing product (methane) loss. The removed nitrogen product may be used as fuel gas or vented to atmosphere. If used as fuel gas, the nitrogen product must contain a fair amount of methane (typically >30 mol %) to maintain its heating value. In this case, the separation of nitrogen is not as difficult due to loose specifications on the purity of the nitrogen product, and the objective there is to select the most efficient process with minimal additional equipment and power consumption. In many small and mid-scale LNG facilities that are driven by electric motors, however, there is very little demand for fuel gas and the nitrogen product has to be vented to the atmosphere. If vented, the nitrogen product has to meet strict purity specifications (e.g., >95 mol %, or >99 mol %), due to environmental concerns and/or due to methane recovery requirements. This purity requirement poses separation challenges. In the case of a very high nitrogen concentration (typically greater than 10 mol %, in some cases up to or even higher than 20 mol %) in the natural gas feed, a dedicated nitrogen rejection unit (NRU) proves to be a robust method to remove nitrogen efficiently and produce a pure (>99 mol %) nitrogen product. In most cases, however, natural gas contains about 1 to 10 mol % nitrogen. When the nitrogen concentration in the feed is within this range, the applicability of the NRU is hindered by the high capital cost due to complexity associated with the additional equipment. A number of prior art documents have proposed alternative solutions to remove nitrogen from natural gas, including adding a nitrogen recycle stream to the NRU or using a dedicated rectifier column. However, these processes often are very complicated, necessitate a large amount of equipment (with associated capital costs), are difficult to operate and/or are inefficient, especially for feed streams of lower nitrogen concentrations (<5 mol %). Furthermore, it is often the case that the nitrogen concentration in a natural gas feed will change from time to time, which means that even if one is dealing with a feed that is currently high in nitrogen content, one cannot guarantee that this will remain the case. It would therefore be desirable to develop a process that is simple, efficient, and capable of removing nitrogen effectively from natural gas feeds with low nitrogen concentrations.

U.S. Pat. No. 3,721,099 discloses a process for liquefying natural gas and separating nitrogen from the liquefied natural gas by rectification. In this process, the natural gas feed is precooled and partially liquefied in a series of heat exchanger units and separated in a phase separator into liquid and vapor phases. The natural gas vapor stream is then liquefied and subcooled in a pipe-coil in the bottom of the double rectification column, providing boilup duty to the high pressure column. The liquid natural gas streams from the pipe-coil is then further subcooled in a heat exchanger unit, expanded in an expansion valve and introduced into and separated in the high pressure column. The methane-rich liquid stream drawn from the bottom of the high-pressure rectification column and the methane-rich liquid stream obtained from the phase separator are subcooled in further heat exchanger units, expanded through expansion valves, and introduced into and separated into the low pressure column. Reflux to the low pressure column is provided by a liquid nitrogen stream obtained from liquefying in a heat exchanger unit a nitrogen stream obtained the top part of the high pressure column. Nitrogen-depleted LNG (predominately liquid methane) product, containing about 0.5% nitrogen, is obtained from the bottom of the low-pressure column and sent to an LNG storage tank. Nitrogen-rich streams are obtained from the top of the low pressure column (containing about 95 mole % nitrogen) and from the top of the high pressure column. The nitrogen-rich streams and boil-off gas from the LNG tank are warmed in the various heat exchanger units to provide refrigeration therefor.

U.S. Pat. No. 7,520,143 discloses a process in which a nitrogen vent stream containing 98 mole % nitrogen is separated by a nitrogen-rejection column. A natural gas feed stream is liquefied in a first (warm) section of a main heat exchanger to produce an LNG stream that is withdrawn from an intermediate location of the heat exchanger, expanded in an expansion valve, and sent to the bottom of the nitrogen-rejection column. The bottom liquid from the nitrogen-rejection column is subcooled in a second (cold) section of the main heat exchanger and expanded through a valve into a flash drum to provide a nitrogen-depleted LNG product (less than 1.5 mole % nitrogen), and a nitrogen-enriched stream which is of lower purity (30 mole % nitrogen) than the nitrogen vent stream and that is used for fuel gas. The overhead vapor from the nitrogen-rejection column is divided, with part of the vapor being withdrawn as the nitrogen vent stream and the remainder being condensed in a heat exchanger in the flash drum to provide reflux to the nitrogen-rejection column. Refrigeration for the main heat exchanger is provided by a closed loop refrigeration system employing a mixed refrigerant.

US 2011/0041389 discloses a process, somewhat similar to that described in U.S. Pat. No. 7,520,143, in which a high purity nitrogen vent stream (typically 90-100% by volume nitrogen) is separated from the natural gas feed stream in a rectification column. The natural gas feed stream is cooled in a warm section of a main heat exchanger to produce a cooled natural gas stream. A portion of this stream is withdrawn from a first intermediate location of the main heat exchanger, expanded and sent to the bottom of the rectification column as stripping gas. The remainder of the stream is further cooled and liquefied in an intermediate section of the main heat exchanger to from an LNG stream that is withdrawn from a second (colder) intermediate location of the heat exchanger, expanded and sent to an intermediate location of the rectification column. The bottom liquid from the rectification column is withdrawn as a nitrogen-depleted LNG stream, subcooled in a cold section of the main heat exchanger and expanded into a phase separator to provide a nitrogen-depleted LNG product, and a nitrogen-enriched stream which is compressed and recycled back into the natural gas feed stream. The overhead vapor from the rectification column is divided, with part of the vapor being withdrawn as the high purity nitrogen vent stream and the remainder being condensed in a heat exchanger in the phase separator to provide reflux to the rectification column.

IPCOM000222164D, a document on the ip.com database, discloses a process in which a stand-alone nitrogen rejection unit (NRU) is used to produce a nitrogen-depleted natural gas stream and a pure nitrogen vent stream. The natural gas feed stream is cooled and partially liquefied in a warm heat exchanger unit and separated in a phase separator into natural gas vapor and liquid streams. The vapor stream is liquefied in cold heat exchanger unit and sent to the top or to an intermediate location of a distillation column. The liquid stream is further cooled in the cold heat exchanger unit, separately from and in parallel with the vapor stream, and is then sent to an intermediate location of the distillation column (below the location at which the vapor stream is introduced). Boil-up for the distillation column is provided by warming and vaporizing a portion of the nitrogen-depleted bottoms liquid from the distillation column in the cold heat exchanger unit, thereby providing also refrigeration for unit. The remainder of the nitrogen-depleted bottoms liquid is pumped to and warmed and vaporized in the warm heat exchanger unit, thereby providing refrigeration for that unit, and leaves the warm exchanger as a fully vaporized vapor stream. The nitrogen enriched overhead vapor withdrawn from the distillation column is warmed in the cold and warm heat exchanger units to provide further refrigeration to said units. Where the vapor stream is introduced into an intermediate location of the distillation column, additional reflux for the column may be provided by condensing a portion of the overhead vapor and returning this to column. This may be done by warming the overhead vapor in an economizer heat exchanger, dividing the warmed overhead vapor, and condensing a portion of the warmed overhead vapor in the economizer heat exchanger and returning the condensed portion to the top of the distillation column. No external refrigeration is used in this process.

US2011/0289963 discloses a process in which nitrogen stripping column is used to separate nitrogen from a natural gas stream. In this process, a natural gas feed stream is cooled and partially liquefied in a warm section of a main heat exchanger via heat exchange with a single mixed refrigerant. The partially condensed natural gas is withdrawn from the main heat exchanger and separated in a phase separator or distillation vessel into natural gas vapor and liquid streams. The liquid stream is further cooled in a cold section of the main heat exchanger before being expanded and introduced into a nitrogen stripping column. A nitrogen-depleted LNG product (containing 1 to 3 volume % nitrogen) is withdrawn from the bottom of the stripping column and a nitrogen-enriched vapor stream (containing less than 10 volume % methane) is withdrawn from the top of the stripping column. The natural gas vapor stream from the phase separator or distillation vessel is expanded and cooled in separate heat exchangers and introduced into the top of the stripping column to provide reflux. Refrigeration to the additional heat exchangers is provided by vaporizing a portion of the bottoms liquid from the stripping column (thereby providing also boil-up from the column) and by warming the nitrogen-enriched vapor stream withdrawn from the top of the stripping column.

U.S. Pat. No. 8,522,574 discloses another process in which nitrogen is removed from liquefied natural gas. In this process, a natural gas feed stream is first cooled and liquefied in a main heat exchanger. The liquid stream is then cooled in a secondary heat exchanger and expanded into a flash vessel where a nitrogen-rich vapor is separated from a methane-rich liquid. The vapor stream is further expanded and sent to the top of a fractionation column. The liquid stream from the flash vessel is divided, with one portion being introducing into an intermediate location of the fractionation column, and another portion being warmed in the secondary heat exchanger and introduced into the bottom of the fractionation column. The nitrogen-rich overhead vapor obtained from the fractionation column is passed through and warmed in the secondary heat exchanger to provide additional refrigeration to said heat exchanger. Product liquefied natural gas is recovered from the bottom of the fractionation column.

US2012/019883 discloses a process for liquefying a natural gas stream and removing nitrogen from it. The natural gas feed stream is liquefied in a main heat exchanger, expanded and introduced into the bottom of a separating column. Refrigeration for the main heat exchanger is provided by a closed-loop refrigeration system circulating a mixed refrigerant. Nitrogen-depleted LNG withdrawn from the bottom of the separating column is expanded and further separated in a phase separator. The nitrogen-depleted LNG from the phase separator is sent to an LNG storage tank. The vapor stream from the phase separator is combined with boil off gas from the LNG storage tank, warmed in the main heat exchanger to provide additional refrigeration to the main heat exchanger, compressed, and recycled into the natural gas feed stream. The nitrogen-enriched vapor (90 to 100 volume % nitrogen) withdrawn from the top of the separating column is also warmed in the main heat exchanger to provide additional refrigeration to the main heat exchanger.

BRIEF SUMMARY

According to a first aspect of the present invention, there is provided a method for producing a nitrogen-depleted LNG product, the method comprising:

(a) introducing a natural gas feed stream into the warm end of a main heat exchanger, cooling and at least partially liquefying the natural gas feed stream, and withdrawing the cooled and at least partially liquefied stream from an intermediate location of the main heat exchanger;

(b) expanding, partially vaporizing and separating the cooled and at least partially liquefied stream to form a nitrogen-enriched natural gas vapor stream and a nitrogen-depleted natural gas liquid stream;

(c) separately re-introducing said vapor and liquid streams into an intermediate location of the main heat exchanger, further cooling the vapor and liquid streams in parallel, the liquid stream being further cooled to form a first LNG stream and the vapor stream being further cooled and at least partially liquefied to form a first at least partially liquefied nitrogen-enriched natural gas stream, and withdrawing the first LNG stream and the first at least partially liquefied nitrogen-enriched natural gas stream from the cold end of the main heat exchanger;

(d) expanding, partially vaporizing and separating the first at least partially liquefied nitrogen-enriched natural gas stream to form a nitrogen-rich vapor product and a second LNG stream; and (e) expanding, partially vaporizing and separating the second LNG stream to form a nitrogen-depleted LNG product and a nitrogen-enriched natural gas vapor.

According to a second aspect of the present invention, there is provided an apparatus for producing a nitrogen-depleted LNG product, the apparatus comprising:

a main heat exchanger having (i) a first cooling passage, extending from a warm end of the heat exchanger to an intermediate location of the heat exchanger, for receiving a natural gas feed stream and cooling and at least partially liquefying said stream so as to produce a cooled and at least partially liquefied stream, (ii) a second cooling passage extending from an intermediate location of the heat exchanger to a cold end of the heat exchanger, for receiving and further cooling a nitrogen-depleted natural gas liquid stream to form a first LNG stream, and (iii) a third cooling passage extending from an intermediate location of the heat exchanger to the cold end of the heat exchanger, for receiving and further cooling a nitrogen-enriched natural gas vapor stream, separately from and in parallel with the nitrogen-depleted natural gas liquid stream, to form a first at least partially liquefied nitrogen-enriched natural gas stream;

a refrigeration system for supplying refrigerant to the main heat exchanger for cooling the cooling passages;

a first separation system, in fluid flow communication with the main heat exchanger, for (i) receiving the cooled and at least partially liquefied stream from the first cooling passage of the main heat exchanger, (ii) expanding, partially vaporizing and separating said stream to form the nitrogen-enriched natural gas vapor stream and the nitrogen-depleted natural gas liquid stream, and (iii) returning said liquid and vapor streams to, respectively, the second and third cooling passages of the main heat exchanger;

a second separation system, in fluid flow communication with the main heat exchanger, for receiving, expanding, partially vaporizing and separating the first at least partially liquefied nitrogen-enriched natural gas stream to form a nitrogen-rich vapor product and a second LNG stream; and a third separation system, in fluid flow communication with the second separation system, for receiving, expanding, partially vaporizing and separating the second LNG stream to form a nitrogen-depleted LNG product and a nitrogen-enriched natural gas vapor.

Preferred aspects of the present invention include the following aspects, numbered #1 to #25:

#1. A method for producing a nitrogen-depleted LNG product, the method comprising:

(a) introducing a natural gas feed stream into the warm end of a main heat exchanger, cooling and at least partially liquefying the natural gas feed stream, and withdrawing the cooled and at least partially liquefied stream from an intermediate location of the main heat exchanger;

(b) expanding, partially vaporizing and separating the cooled and at least partially liquefied stream to form a nitrogen-enriched natural gas vapor stream and a nitrogen-depleted natural gas liquid stream;

(c) separately re-introducing said vapor and liquid streams into an intermediate location of the main heat exchanger, further cooling the vapor and liquid streams in parallel, the liquid stream being further cooled to form a first LNG stream and the vapor stream being further cooled and at least partially liquefied to form a first at least partially liquefied nitrogen-enriched natural gas stream, and withdrawing the first LNG stream and the first at least partially liquefied nitrogen-enriched natural gas stream from the cold end of the main heat exchanger;

(d) expanding, partially vaporizing and separating the first at least partially liquefied nitrogen-enriched natural gas stream to form a nitrogen-rich vapor product and a second LNG stream; and (e) expanding, partially vaporizing and separating the second LNG stream to form a nitrogen-depleted LNG product and a nitrogen-enriched natural gas vapor.

#2. The method of Aspect #1, wherein step (e) further comprises forming a recycle stream from the nitrogen-enriched natural gas vapor or a portion thereof; and wherein the method further comprises;

(f) compressing the recycle stream to form a compressed recycle stream; and (g) returning the compressed recycle stream to the main heat exchanger to be cooled and at least partially liquefied in combination with or separately from the natural gas feed stream.

#3. The method of Aspect #2, wherein step (g) comprises adding the compressed recycle stream to the natural gas feed stream such that the recycle stream is cooled and at least partially liquefied in the main heat exchanger in combination with and as part of the natural gas feed stream.

#4. The method of Aspect #2, wherein step (g) comprises introducing the compressed recycle stream into the warm end or an intermediate location of the main heat exchanger, cooling the compressed recycle stream and at least partially liquefying all or a portion thereof, separately from and in parallel with the natural gas feed stream, to form a second at least partially liquefied nitrogen-enriched natural gas stream, and withdrawing the second at least partially liquefied nitrogen-enriched natural gas stream from the cold end of the main heat exchanger.

#5. The method of any one of Aspects #1 to #4, wherein step (b) comprises expanding and partially vaporizing the cooled and at least partially liquefied stream and separating said stream in a phase separator into vapor and liquid phases to form the nitrogen-enriched natural gas vapor stream and the nitrogen-depleted natural gas liquid stream

#6. The method of any one of Aspects #1 to #5, wherein step (e) comprises expanding the second LNG stream, transferring the expanded stream into an LNG storage tank in which a portion of the LNG vaporizes, thereby forming the nitrogen-enriched natural gas vapor and the nitrogen-depleted LNG product.

#7. The method of any one of Aspects #1 to #6, wherein step (d) comprises expanding and partially vaporizing the first at least partially liquefied nitrogen-enriched natural gas stream and separating said stream in a phase separator into vapor and liquid phases to form the nitrogen-rich vapor product and the second LNG stream.

#8. The method of Aspect #7, wherein step (e) further comprises expanding, partially vaporizing and separating the first LNG stream to produce additional nitrogen-depleted LNG product and additional nitrogen-enriched natural gas vapor.

#9. The method of any one of Aspects #1 to #6, wherein step (d) comprises expanding and partially vaporizing the first at least partially liquefied nitrogen-enriched natural gas stream, introducing said stream into a distillation column to separate the stream into vapor and liquid phases, forming the nitrogen-rich vapor product from overhead vapor withdrawn from the distillation column, and forming the second LNG stream from bottoms liquid withdrawn from the distillation column.

#10. The method of Aspect #9, wherein step (e) further comprises expanding, partially vaporizing and separating the first LNG stream to produce additional nitrogen-depleted LNG product and additional nitrogen-enriched natural gas vapor.

#11. The method of Aspect #9, wherein step (d) further comprises expanding and partially vaporizing the first LNG stream and introducing said stream into the distillation column to separate the stream into vapor and liquid phases, the first LNG stream being introduced into the distillation column at a location below the location at which the first at least partially liquefied nitrogen-enriched natural gas stream is introduced into the distillation column.

#12. The method of Aspect #11, wherein the first LNG stream is introduced into the distillation column at an intermediate location of the column, and boil-up for the distillation column is provided by heating and vaporizing a portion of the bottoms liquid in a reboiler heat exchanger via indirect heat exchange with the first LNG stream prior to introduction of the first LNG stream into the distillation column.

#13. The method of Aspect #11, wherein the first LNG stream is introduced into the bottom of the distillation column.

#14. The method of any one of Aspects #9 to #12, wherein boil-up for the distillation column is provided by heating and vaporizing a portion of the bottoms liquid in a reboiler heat exchanger via indirect heat exchange with all or a portion of the first at least partially liquefied nitrogen-enriched natural gas stream prior to the introduction of said stream into the distillation column.

#15. The method of any one of Aspects #9 to #14, wherein:

step (b) comprises expanding, partially vaporizing and separating the cooled and at least partially liquefied stream to form the nitrogen-enriched natural gas vapor stream, a stripping gas stream composed of nitrogen-enriched natural gas vapor, and the nitrogen-depleted natural gas liquid stream; and step (d) further comprises introducing the stripping gas stream into the bottom of the distillation column.

#16. The method of any one of Aspects #9 to #15 when dependent on Aspect #4, wherein step (d) further comprises expanding and partially vaporizing the second at least partially liquefied nitrogen-enriched natural gas stream and introducing said stream into the distillation column to separate the stream into vapor and liquid phases.

#17. The method of Aspect #16, wherein the second at least partially liquefied nitrogen-enriched natural gas stream is introduced into the top of the distillation column.

#18. The method of any one of Aspects #9 to #15, wherein the first at least partially liquefied nitrogen-enriched natural gas stream is introduced into the top of the distillation column.

#19. The method of any one of Aspects #9 to #16, wherein reflux for the distillation column is provided by condensing a portion of the overhead vapor from the distillation column in a condenser heat exchanger.

#20. The method of Aspect #19, wherein refrigeration for the condenser heat exchanger is provided by warming overhead vapor withdrawn from the distillation column.

#21. The method of Aspect #19 or #20, wherein refrigeration for the condenser heat exchanger is provided by a closed loop refrigeration system that likewise provides refrigeration for the main heat exchanger, refrigerant circulated by the closed loop refrigeration system passing through and being warmed in the condenser heat exchanger.

#22. The method of any one of Aspects #1 to #21, wherein refrigeration for the main heat exchanger is provided by a closed loop refrigeration system, refrigerant circulated by the closed loop refrigeration system passing through and being warmed in the main heat exchanger.

#23. An apparatus for producing a nitrogen-depleted LNG product, the apparatus comprising:

a main heat exchanger having (i) a first cooling passage, extending from a warm end of the heat exchanger to an intermediate location of the heat exchanger, for receiving a natural gas feed stream and cooling and at least partially liquefying said stream so as to produce a cooled and at least partially liquefied stream, (ii) a second cooling passage extending from an intermediate location of the heat exchanger to a cold end of the heat exchanger, for receiving and further cooling a nitrogen-depleted natural gas liquid stream to form a first LNG stream, and (iii) a third cooling passage extending from an intermediate location of the heat exchanger to the cold end of the heat exchanger, for receiving and further cooling a nitrogen-enriched natural gas vapor stream, separately from and in parallel with the nitrogen-depleted natural gas liquid stream, to form a first at least partially liquefied nitrogen-enriched natural gas stream;

a refrigeration system for supplying refrigerant to the main heat exchanger for cooling the cooling passages;

a first separation system, in fluid flow communication with the main heat exchanger, for (i) receiving the cooled and at least partially liquefied stream from the first cooling passage of the main heat exchanger, (ii) expanding, partially vaporizing and separating said stream to form the nitrogen-enriched natural gas vapor stream and the nitrogen-depleted natural gas liquid stream, and (iii) returning said liquid and vapor streams to, respectively, the second and third cooling passages of the main heat exchanger;

a second separation system, in fluid flow communication with the main heat exchanger, for receiving, expanding, partially vaporizing and separating the first at least partially liquefied nitrogen-enriched natural gas stream to form a nitrogen-rich vapor product and a second LNG stream; and a third separation system, in fluid flow communication with the second separation system, for receiving, expanding, partially vaporizing and separating the second LNG stream to form a nitrogen-depleted LNG product and a nitrogen-enriched natural gas vapor.

#24. An apparatus according to Aspect #23, wherein the apparatus further comprises a compressor system, in fluid flow communication with the third separation system and main heat exchanger, for receiving a recycle stream from the third separation system, formed from the nitrogen-enriched natural gas vapor or a portion thereof, compressing the recycle stream to form a compressed recycle stream, and returning the compressed recycle stream to the main heat exchanger to be cooled and at least partially liquefied in combination with or separately from the natural gas feed stream.

#25. An apparatus according to Aspect #23 or #24, wherein the refrigeration system is a closed loop refrigeration system, the first separation system comprises an expansion device and a phase separator, the second separation system comprises an expansion device and a phase separator or a distillation column, and the third separation system comprises an expansion device and an LNG tank.

DETAILED DESCRIPTION

Figure 1:
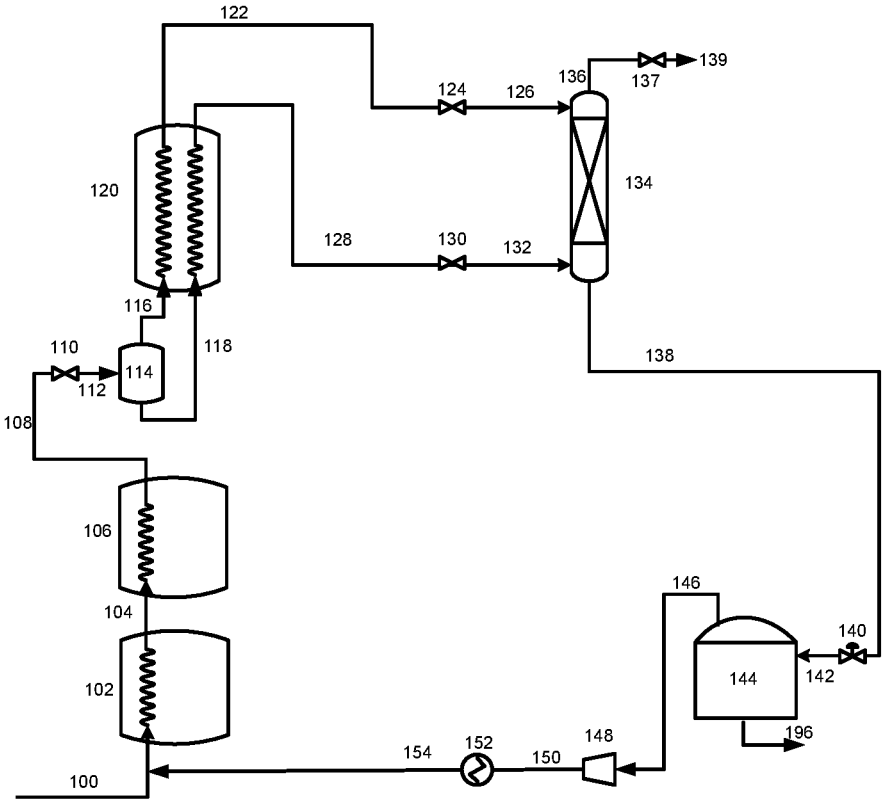
FIG. 1 is a schematic flow diagram depicting a method and apparatus according to one embodiment of the present invention, for liquefying and removing nitrogen from a natural gas stream to produce a nitrogen-depleted LNG product.

Unless otherwise indicated, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

As noted above, according to a first aspect of the present invention there is provided a method for producing a nitrogen-depleted LNG product comprising:

(a) introducing a natural gas feed stream into the warm end of a main heat exchanger, cooling and at least partially liquefying the natural gas feed stream, and withdrawing the cooled and at least partially liquefied stream from an intermediate location of the main heat exchanger;

(b) expanding, partially vaporizing and separating the cooled and at least partially liquefied stream to form a nitrogen-enriched natural gas vapor stream and a nitrogen-depleted natural gas liquid stream;

(c) separately re-introducing said vapor and liquid streams into an intermediate location of the main heat exchanger, further cooling the vapor and liquid streams in parallel, the liquid stream being further cooled to form a first LNG stream and the vapor stream being further cooled and at least partially liquefied to form a first at least partially liquefied nitrogen-enriched natural gas stream, and withdrawing the first LNG stream and the first at least partially liquefied nitrogen-enriched natural gas stream from the cold end of the main heat exchanger;

(d) expanding, partially vaporizing and separating the first at least partially liquefied nitrogen-enriched natural gas stream to form a nitrogen-rich vapor product and a second LNG stream; and (e) expanding, partially vaporizing and separating the second LNG stream to form a nitrogen-depleted LNG product and a nitrogen-enriched natural gas vapor.

In preferred embodiments, step (e) further comprises forming a recycle stream from the nitrogen-enriched natural gas vapor or a portion thereof; and the method further comprises;

(f) compressing the recycle stream to form a compressed recycle stream; and (g) returning the compressed recycle stream to the main heat exchanger to be cooled and at least partially liquefied in combination with or separately from the natural gas feed stream.

As used herein, the term "natural gas" encompasses also synthetic and substitute natural gases. The natural gas feed stream comprises methane and nitrogen (with methane typically being the major component). Typically the natural gas feed stream has nitrogen concentration of from 1 to 10 mol %, and the methods and apparatus described herein can effectively remove nitrogen from the natural gas feed stream even where the nitrogen concentration in the natural gas feed stream is relatively low, such as 5 mol % or below. The natural gas stream will usual also contain other components, such as for example one or more other hydrocarbons and/or other components such as helium, carbon dioxide, hydrogen, etc. However, it should not contain any additional components at concentrations that will freeze in the main heat exchanger during cooling and liquefaction of the stream. Accordingly, prior to being introduced into the main heat exchanger, the natural gas feed stream may be pretreated if and as necessary to remove water, acid gases, mercury and heavy hydrocarbons from the natural gas feed stream, so as to reduce the concentrations of any such components in the natural gas feed stream down to such levels as will not result in any freezing problems.

As used herein, and unless otherwise indicated, a stream is "nitrogen-enriched" if the concentration of nitrogen in the stream is higher than the concentration of nitrogen in the natural gas feed stream. A stream is "nitrogen-depleted" if the concentration of nitrogen in the stream is lower than the concentration of nitrogen in the natural gas feed stream. In the method according to the first aspect of the present invention as described above, the nitrogen-rich vapor product has a higher nitrogen concentration than the first at least partially liquefied nitrogen-enriched natural gas stream (and thus may be described as being further enriched in nitrogen, relative to the natural gas feed stream). Where the natural gas feed stream contains other components in addition to methane and nitrogen, streams that are "nitrogen-enriched" may also be enriched in other light components (e.g. other components having a boiling point similar to or lower than that of nitrogen, such as for example helium), and streams that are "nitrogen-depleted" may also be depleted in other heavy components (e.g. other components having a boiling point similar to or higher than that of methane, such as for example heavier hydrocarbons).

As used herein, the term "main heat exchanger" refers to the heat exchanger responsible for cooling and liquefying all or a portion of the natural gas stream to produce the first LNG stream. As is described below in more detail, the heat exchanger may be composed of one or more cooling sections arranged in series and/or in parallel. Each such sections may constitute a separate heat exchanger unit having its own housing, but equally sections may be combined into a single heat exchanger unit sharing a common housing. The heat exchanger unit(s) may be of any suitable type, such as but not limited to shell and tube, wound coil, or plate and fin types of heat exchanger unit. In such units, each cooling section will typically comprise its own tube bundle (where the unit is of the shell and tube or wound coil type) or plate and fin bundle (where the unit is of the plate and fin types). As used herein, the "warm end" and "cold end" of the main heat exchanger are relative terms, referring to the ends of the main heat exchanger that are of the highest and lowest temperature (respectively), and are not intended to imply any particular temperature ranges, unless otherwise indicated. The phrase "an intermediate location" of the main heat exchanger refers to a location between the warm and cold ends, typically between two cooling sections that are in series.

Typically, some or all of the refrigeration for the main heat exchanger is provided by a closed loop refrigeration system, refrigerant circulated by the closed loop refrigeration system passing through and being warmed in the main heat exchanger. The closed loop refrigeration system (or closed loop refrigeration systems, where more than one is used to provide refrigeration to the main heat exchanger) may be of any suitable type. Exemplary refrigeration systems, comprising one or more close loop systems, that may be used in accordance with the present invention include the single mixed refrigerant (SMR) system, the dual mixed refrigerant (DMR) system, the hybrid propane mixed refrigerant (C3MR) system, the nitrogen expansion cycle (or other gaseous expansion cycle) system, and the cascade refrigeration system.

In the methods and apparatus described herein, and unless otherwise indicated, streams may be expanded and/or, in the case of liquid or two-phase streams, expanded and partially vaporized by passing the stream through any suitable expansion device. A stream may, for example, be expanded and partially vaporized by being passed through an expansion valve or J-T valve, or any other device for effecting (essentially) isenthalpic expansion (and hence flash evaporation) of the stream. Additionally or alternatively, a stream may for example be expanded and partially vaporized by being passed and work expanded through a work-extracting device, such as for example a hydraulic turbine or turbo expander, thereby effecting (essentially) isentropic expansion of the stream.

In one embodiment, step (g) of the method comprises adding the compressed recycle stream to the natural gas feed stream such that the recycle stream is cooled and at least partially liquefied in the main heat exchanger in combination with and as part of the natural gas feed stream.

In another embodiment, step (g) of the method comprises introducing the compressed recycle stream into the warm end or an intermediate location of the main heat exchanger, cooling the compressed recycle stream and at least partially liquefying all or a portion thereof, separately from and in parallel with the natural gas feed stream, to form a second at least partially liquefied nitrogen-enriched natural gas stream, and withdrawing the second at least partially liquefied nitrogen-enriched natural gas stream from the cold end of the main heat exchanger.

In a preferred embodiment, step (b) of the method uses a phase separator to separate the cooled and at least partially liquefied natural gas feed stream to form the nitrogen-enriched natural gas vapor stream and the nitrogen-depleted natural gas liquid stream. Thus, step (b) may comprise expanding and partially vaporizing the cooled and at least partially liquefied stream and separating said stream in a phase separator into vapor and liquid phases to form the nitrogen-enriched natural gas vapor stream and the nitrogen-depleted natural gas liquid stream.

As used herein, the term "phase separator" refers to a device, such as drum or other form of vessel, in which a two phase stream can be introduced in order to separate the stream into its constituent vapor and liquid phases. In contrast to a distillation column (discussed below), the vessel does not contain any separation sections designed to effect mass transfer between countercurrent liquid and vapor flows inside the vessel. Where a stream is to be expanded (or expanded and partially vaporized) prior to being separated, the expansion device for expanding the stream and the phase separator for separating the stream may be combined into a single device, such as for example a flash drum (in which the inlet to the drum incorporates an expansion valve).

In a preferred embodiment, In a preferred embodiment, step (e) of the method uses an LNG storage tank to separate the second LNG stream to form the nitrogen-enriched natural gas vapor and the nitrogen-depleted LNG product. Thus, step (e) of the method may comprise expanding the second LNG stream, transferring the expanded stream into an LNG storage tank in which a portion of the LNG vaporizes, thereby forming the nitrogen-enriched natural gas vapor and the nitrogen-depleted LNG product.

In one embodiment, step (d) of the method uses a phase separator to separate the first at least partially liquefied nitrogen-enriched natural gas stream to form the nitrogen-rich vapor product and the second LNG stream. Thus, step (d) of the method may comprise expanding and partially vaporizing the first at least partially liquefied nitrogen-enriched natural gas stream and separating said stream in a phase separator into vapor and liquid phases to form the nitrogen-rich vapor product and the second LNG stream.

Where step (d) uses a phase separator as described above, step (e) of the method preferably further comprises expanding, partially vaporizing and separating the first LNG stream to produce additional nitrogen-depleted LNG product and additional nitrogen-enriched natural gas vapor. In this and other embodiments where the first LNG stream is also expanded, partially vaporized and separated to produce additional nitrogen-enriched natural gas vapor and additional nitrogen-depleted LNG product, this may be carried out by combining the first and second LNG streams and then expanding, partially vaporizing and separating the combined stream; by separately expanding and partially vaporizing the streams, combining the expanded streams, and then separating the combined stream; or by expanding, partially vaporizing and separating each stream individually.

In another embodiment, step (d) of the method uses a distillation column to separate the first at least partially liquefied nitrogen-enriched natural gas stream to form the nitrogen-rich vapor product and the second LNG stream. Thus, step (d) of the method may comprise expanding and partially vaporizing the first at least partially liquefied nitrogen-enriched natural gas stream, introducing said stream into a distillation column to separate the stream into vapor and liquid phases, forming the nitrogen-rich vapor product from overhead vapor withdrawn from the distillation column, and forming the second LNG stream from bottoms liquid withdrawn from the distillation column.

As used herein, the term "distillation column" refers to a column (or set of columns) containing one or more separation sections, each separation section being composed of inserts, such as packing and/or one or more trays, that increase contact and thus enhance mass transfer between the upward rising vapor and downward flowing liquid flowing through the section inside the column. In this way, the concentration of lighter components (such as nitrogen) in the overhead vapor, i.e. the vapor that collects at the top of the column, is increased, and the concentration of heavier components (such as methane) in the bottoms liquid, i.e. the liquid that collects at the bottom of the column, is increased. The "top" of the column refers to the part of the column above the separation sections. The "bottom" of the column refers to the part of the column below the separation sections. An "intermediate location" of the column refers to a location between the top and bottom of the column, typically between two separation sections that are in series.

Where step (d) uses a distillation column as described above, step (e) of the method may further comprise expanding, partially vaporizing and separating the first LNG stream to produce additional nitrogen-depleted LNG product and additional nitrogen-enriched natural gas vapor. Again, in this case the first LNG stream and second LNG stream may be expanded and/or separated individually or in combination, as described above.

Alternatively, step (d) may further comprise expanding and partially vaporizing the first LNG stream and introducing said stream into the distillation column to separate the stream into vapor and liquid phases, the first LNG stream being introduced into the distillation column at a location below the location at which the first at least partially liquefied nitrogen-enriched natural gas stream is introduced into the distillation column. The first LNG stream may be introduced into the distillation column at an intermediate location of the column. The first LNG stream may be introduced into the bottom of the distillation column.

Boil-up for the distillation column may be provided by heating and vaporizing a portion of the bottoms liquid in a reboiler heat exchanger via indirect heat exchange with the first LNG stream prior to introduction of the first LNG stream into the distillation column.

Boil-up for the distillation column may be provided by heating and vaporizing a portion of the bottoms liquid in a reboiler heat exchanger via indirect heat exchange with all or a portion of the first at least partially liquefied nitrogen-enriched natural gas stream prior to the introduction of said stream into the distillation column.

Boil-up for the distillation column may be provided by heating and vaporizing a portion of the bottoms liquid in a reboiler heat exchanger against an external heat source (for example such as, but not limited to, an electric heater).

In one embodiment, step (b) of the method may comprise expanding, partially vaporizing and separating the cooled and at least partially liquefied stream to form the nitrogen-enriched natural gas vapor stream, a stripping gas stream composed of nitrogen-enriched natural gas vapor, and the nitrogen-depleted natural gas liquid stream. Step (d) of the method may then further comprise introducing the stripping gas stream into the bottom of the distillation column.

Step (d) of the method may further comprise the introduction of a stripping gas stream, generated from any suitable source, into the bottom of the distillation column. In addition to the stripping gas streams generated from the sources described above, additional or alternative sources may include forming a stripping gas stream from a portion of the compressed recycle gas prior to the remaining compressed recycle being returned to the main heat exchanger; and forming a stripping gas stream from a portion of the natural gas feed.

Preferably, the first at least partially liquefied nitrogen-enriched natural gas stream is introduced into the top of the distillation column, or into the distillation column at an intermediate location of the column.

If desired, the first at least partially liquefied nitrogen-enriched natural gas stream may be expanded, partially vaporized and separated into separate vapor and liquid streams prior to being introduced into the distillation column, the liquid stream being introduced into the distillation column at an intermediate location, and the vapor stream being cooled and at least partially condensed in a condenser heat exchanger, via indirect heat exchange with the overhead vapor withdrawn from the column, and then being introduced into the top of the column. The first at least partially liquefied nitrogen-enriched natural gas stream is in this case preferably separated into the separate vapor and liquid streams in a phase separator. Where the first at least partially liquefied nitrogen-enriched natural gas stream is already a two-phase stream, minimal additional expansion and vaporization of the stream may be needed, in which case it may not be necessary to pass the stream through an expansion device before introducing the stream into the phase separator (any expansion and vaporization needed being effected by the expansion and vaporization that will inevitably occur on introduction of a two-phase stream into a drum or other such vessel).

In those embodiments where the compressed recycle stream is separately cooled in the main heat exchanger to form a second at least partially liquefied nitrogen-enriched natural gas stream, step (d) of the method may further comprise expanding and partially vaporizing the first at least partially liquefied nitrogen-enriched natural gas stream and introducing said stream into a distillation column to separate the stream into vapor and liquid phases, expanding and partially vaporizing the second at least partially liquefied nitrogen-enriched natural gas stream and introducing said stream into the distillation column to separate the stream into vapor and liquid phases, forming the nitrogen-rich vapor product from overhead vapor withdrawn from the distillation column, and forming the second LNG stream from bottoms liquid withdrawn from the distillation column. In this embodiment, it is preferable that the second at least partially liquefied nitrogen-enriched natural gas stream is introduced into the top of the distillation column.

Reflux for the distillation column may be provided by condensing a portion of the overhead vapor from the distillation column in a condenser heat exchanger. Refrigeration for the condenser heat exchanger may be provided by warming overhead vapor withdrawn from the distillation column. Refrigeration for the condenser heat exchanger may be provided by a closed loop refrigeration system that likewise provides refrigeration for the main heat exchanger, refrigerant circulated by the closed loop refrigeration system passing through and being warmed in the condenser heat exchanger.

As also noted above, according to a second aspect of the present invention there is provided an apparatus for producing a nitrogen-depleted LNG product, the apparatus comprising:

a main heat exchanger having (i) a first cooling passage, extending from a warm end of the heat exchanger to an intermediate location of the heat exchanger, for receiving a natural gas feed stream and cooling and at least partially liquefying said stream so as to produce a cooled and at least partially liquefied stream, (ii) a second cooling passage extending from an intermediate location of the heat exchanger to a cold end of the heat exchanger, for receiving and further cooling a nitrogen-depleted natural gas liquid stream to form a first LNG stream, and (iii) a third cooling passage extending from an intermediate location of the heat exchanger to the cold end of the heat exchanger, for receiving and further cooling a nitrogen-enriched natural gas vapor stream, separately from and in parallel with the nitrogen-depleted natural gas liquid stream, to form a first at least partially liquefied nitrogen-enriched natural gas stream;

a refrigeration system for supplying refrigerant to the main heat exchanger for cooling the cooling passages;

a first separation system, in fluid flow communication with the main heat exchanger, for (i) receiving the cooled and at least partially liquefied stream from the first cooling passage of the main heat exchanger, (ii) expanding, partially vaporizing and separating said stream to form the nitrogen-enriched natural gas vapor stream and the nitrogen-depleted natural gas liquid stream, and (iii) returning said liquid and vapor streams to, respectively, the second and third cooling passages of the main heat exchanger;

a second separation system, in fluid flow communication with the main heat exchanger, for receiving, expanding, partially vaporizing and separating the first at least partially liquefied nitrogen-enriched natural gas stream to form a nitrogen-rich vapor product and a second LNG stream; and a third separation system, in fluid flow communication with the second separation system, for receiving, expanding, partially vaporizing and separating the second LNG stream to form a nitrogen-depleted LNG product and a nitrogen-enriched natural gas vapor.

As used herein, the term "fluid flow communication" indicates that the devices or systems in question are connected to each other in such a way that the streams that are referred to can be sent and received by the devices or systems in question. The devices or systems may, for example be connected, by suitable tubes, passages or other forms of conduit for transferring the streams in question.

The apparatus according to the second aspect of the invention is suitable for carrying out a method in accordance with the first aspect of the invention. Thus, various preferred or optional features and embodiments of apparatus in accordance with the second aspect will be apparent from the preceding discussion of the various preferred or optional embodiments and features of the method in accordance with the first aspect.

For example, in preferred embodiments the apparatus further comprises a compressor system, in fluid flow communication with the third separation system and main heat exchanger, for receiving a recycle stream from the third separation system, formed from the nitrogen-enriched natural gas vapor or a portion thereof, compressing the recycle stream to form a compressed recycle stream, and returning the compressed recycle stream to the main heat exchanger to be cooled and at least partially liquefied in combination with or separately from the natural gas feed stream. The refrigeration system preferably comprises a closed loop refrigeration system. The first separation system preferably comprises an expansion device and a phase separator. The second separation system may for example comprise an expansion device and a phase separator, an expansion device and a distillation column, or some combination thereof. The third separation system preferably comprises an expansion device and an LNG tank.

Solely by way of example, various preferred embodiment of the invention will now be described with reference to FIGS. 1 to 7. In these Figures, where a feature is common to more than one Figure that feature has been assigned the same reference numeral in each Figure, for clarity and brevity.

Referring to FIG. 1, a method and apparatus for liquefying and removing nitrogen a natural gas stream according to one embodiment of the present invention is shown.

Natural gas feed stream 100 is first passed through a set of cooling passages in a main heat exchanger to cool the natural gas stream and to liquefy and (typically) sub-cool a portion thereof, thereby producing a first LNG stream 128, as will be described in further detail below. The natural gas feed stream comprises methane and nitrogen. Typically the natural gas feed stream has a nitrogen concentration of from 1 to 10 mol %, and the methods and apparatus described herein can effectively remove nitrogen from the natural gas even where the nitrogen concentration in the natural gas feed stream is relatively low, such as 5 mol % or below. As is well known in the art, the natural gas feed stream should not contain any additional components at concentrations that will freeze in the main heat exchanger during cooling and liquefaction of the stream. Accordingly, prior to being introduced into the main heat exchanger, the natural gas feed stream may be pretreated if and as necessary to remove water, acid gases, mercury and heavy hydrocarbons from the natural gas feed stream, so as to reduce the concentrations of any such components in the natural gas feed stream down to such levels as will not result in any freezing problems. Appropriate equipment and techniques for effecting dehydration, acid-gas removal, mercury removal and heavy hydrocarbon removal are well known. The natural gas stream must also be at above-ambient pressure, and thus may be compressed and cooled if and as necessary in one or more compressors and aftercoolers (not shown) prior to being introduced into the main heat exchanger.

In the embodiment depicted in FIG. 1, the main heat exchanger is composed of three cooling sections in series, namely, a warm section 102 in which the natural gas feed stream 100 is pre-cooled, a middle or intermediate section 106 in which the cooled natural gas feed stream 104 is at least partially liquefied, and a cold section 120 in which a liquefied portion 118 of the natural gas feed stream is sub-cooled, the end of warm section 102 into which the natural gas feed stream 100 is introduced therefore constituting the warm end of the main heat exchanger, and the end of the cold section 120 from which the first LNG stream 128 is withdrawn therefore constituting the cold end of the main heat exchanger. As will be recognized, the terms 'warm' and 'cold' in this context refer only to the relative temperatures inside the cooling sections, and do not imply any particular temperature ranges. In the arrangement depicted FIG. 1, each of these sections constitutes a separate heat exchanger unit having its own shell, casing or other form of housing, but equally two or all three of the sections could be combined into a single heat exchanger unit sharing a common housing. The heat exchanger unit(s) may be of any suitable type, such as but not limited to shell and tube, wound coil, or plate and fin types of heat exchanger unit. In such units, each cooling section will typically comprise its own tube bundle (where the unit is of the shell and tube or wound coil type) or plate and fin bundle (where the unit is of the plate and fin types).

Some or all of the refrigeration for the main heat exchanger may be provided by any suitable closed loop refrigeration system (not shown). Exemplary refrigeration systems that may be used include a single mixed refrigerant (SMR) system, a dual mixed refrigerant (DMR) system, a hybrid propane mixed refrigerant (C3MR) system, and a nitrogen expansion cycle (or other gaseous expansion cycle) system, and a cascade refrigeration system. In the SMR and nitrogen expansion cycle systems, refrigeration is supplied to all three sections 102, 106, 110 of the main heat exchanger by a single mixed refrigerant (in the case of the SMR system) or by nitrogen (in the case of the nitrogen expansion cycle system) circulated by a closed loop refrigeration system. In the DMR and C3MR systems, two separate closed loop refrigeration systems circulating two separate refrigerants (two different mixed refrigerants in the case of the DMR system, and a propane refrigerant and mixed refrigerant in the case of the C3MR system) are used to supply refrigerant to the main heat exchanger, such that different sections of the main heat exchanger may be cooled by different closed loop systems. The operation of SMR, DMR, C3MR, nitrogen expansion cycle and other such closed loop refrigeration systems are well known.

The natural gas feed stream 100 is introduced into the warm end of the main heat exchanger and passes through a first cooling passage running through the warm 102 and middle 106 sections of the main heat exchanger, in which the stream is cooled and at least partially liquefied, thereby producing a cooled and at least partially liquefied natural gas stream 108. The cooled and at least partially liquefied natural gas stream 108 is then withdrawn from an intermediate location of the main heat exchanger, between the middle and cold sections of the main heat exchanger, and expanded, partially vaporized an separated in a first separation system, composed of a expansion device, such as a J-T valve 110 or work-extracting device (e.g. hydraulic turbine or turbo expander (not shown)), and phase separator (such as a flash drum) 114, to form a nitrogen-enriched natural gas vapor stream 116 and a nitrogen-depleted natural gas liquid stream 118. More specifically, the at least partially liquefied natural gas stream 108 passes through the expansion device 110 to form an expanded and partially vaporized stream 112 that is separated in the phase separator 114 into vapor and liquid phases so as to form said vapor 116 and liquid 118 streams. The vapor 116 and liquid 118 streams are then separately re-introduced into an intermediate location of the main heat exchanger, between the middle 106 and cold 120 sections, to be further cooled in parallel in the cold section 120 of the main heat exchanger. More specifically, the nitrogen-depleted natural gas liquid stream 118 is introduced into and passed through a second cooling passage, running through the cold section 120 of the main heat exchanger, in which the stream is subcooled to form the first (sub-cooled) LNG stream 128. The nitrogen-enriched natural gas vapor stream 116 is introduced into and passed through a third cooling passage, that runs through the cold section 120 of the main heat exchanger separately from and in parallel with the second cooling passage, in which the stream cooled and at least partially liquefied to form a first at least partially liquefied (i.e. a partially or fully liquefied) nitrogen-enriched natural gas stream 122. The first LNG stream 128 and the first at least partially liquefied nitrogen-enriched natural gas stream 122 are then withdrawn from the cold end of the main heat exchanger.

The first at least partially liquefied nitrogen-enriched natural gas stream 122 and the first LNG stream 128 are then expanded, partially vaporized and introduced into a distillation column 134 in which they are separated into vapor and liquid phases to form a nitrogen rich vapor product 136, 139 and a second LNG stream 138. The distillation column 134 comprises a separation section, composed of inserts such as packing and/or one or more trays, that increases contact and thus enhances mass transfer between the upward rising vapor and downward flowing liquid inside the column. The first at least partially liquefied nitrogen-enriched natural gas stream 122 is expanded and partially vaporized by being passed through an expansion device, such as for example through a J-T valve 124 or turbo-expander (not shown), forming an expanded and partially vaporized stream 126 that is introduced into the top of the distillation column, above the separation section, for separation into vapor and liquid phases, thereby providing also reflux for the column. The first LNG stream 128 is expanded and partially vaporized by being passed through an expansion device, such as for example through a J-T valve 130 or turbo-expander (not shown), forming an expanded and partially vaporized stream 132 that is introduced into the bottom of the distillation column, below the separation section, for separation into vapor and liquid phases, thereby providing also stripping gas for the column. Where the first at least partially liquefied nitrogen-enriched natural gas stream 122 is a partially liquefied (i.e. two-phase) stream, this stream could in an alternative embodiment (not shown) also be separated in a phase separator into separate vapor and liquid streams before it is expanded and introduced into the distillation. In this case, after the first at least partially liquefied nitrogen-enriched natural gas stream 122 has been separate in the phase separator into the liquid and vapor streams both of these streams would then expanded (and in the case of the liquid stream partially vaporized) by being passed through an expansion device, such as a J-T valve or turbo-expander, before being separately introduced into the distillation column.

The overhead vapor from the distillation column 134 is further enriched in nitrogen (i.e. it is enriched in nitrogen relative to the first at least partially liquefied nitrogen-enriched natural gas stream 122 and thus further enriched in nitrogen relative to the natural gas feed stream 100) and is withdrawn from the top of the distillation column 134 forming the nitrogen-rich vapor product stream 136, which passes through control valve 137 (which controls the operating pressure of the distillation column) to form the final nitrogen-rich vapor product stream 139 (which can then be used as fuel or vented, depending on its composition). The final nitrogen-rich vapor product stream 139 can be warmed by heat integration with other refrigerant streams to recover refrigeration (not shown). The bottoms liquid from the distillation column is further depleted in nitrogen (i.e. it is depleted in nitrogen relative to the first LNG stream 128 formed from nitrogen-depleted natural gas liquid stream 118, and thus is further depleted in nitrogen relative to the natural gas feed stream 100), and is withdrawn from the bottom of the distillation column 134 forming the second LNG stream 138.

The second LNG stream 138 is then further expanded, for example by passing the stream through an expansion device such as a J-T valve 140 or turbo-expander (not shown), to form an expanded LNG stream 142 that is introduced into an LNG storage tank 144. Inside the LNG storage tank 144 a portion of the LNG vaporizes, as a result of the initial expansion and introduction of the LNG into the tank and/or as a result ambient heating over time (since the storage tank cannot be perfectly insulated), producing a nitrogen enriched natural gas vapor that collects in and is withdrawn from the headspace of the tank as recycle stream 146, and leaving behind a nitrogen-depleted LNG product that is stored in the tank and can be withdrawn as product stream 196. In an alternative embodiment (not depicted), LNG storage tank 128 could be replaced with a phase separator (such as a flash drum) or other form of separation device in which the expanded LNG stream 142 is separated into liquid and vapor phases forming, respectively, the nitrogen depleted LNG product 196 and recycle stream 146 composed of nitrogen enriched natural gas vapor. In the case where an LNG storage tank is used, the nitrogen enriched natural gas vapor that collects in and is withdrawn from the headspace of the tank may also be referred to as a tank flash gas (TFG) or boil-off gas (BOG). In the case where a phase separator is used, the nitrogen enriched natural gas vapor that is formed in and withdrawn from the phase separator may also be referred to as an end-flash gas (EFG).

The recycle stream 146 composed of nitrogen enriched natural gas vapor is then recompressed in one or more compressors 148 and cooled in one or more aftercoolers 152 to form a compressed recycle stream 154 that is recycled back to the main heat exchanger (hence the reason for this stream being referred to as a recycle stream) by being, in this embodiment, introduced back into the natural gas feed stream 100 so that it is cooled and at least partially liquefied in the main heat exchanger in combination with and as part of the natural gas feed stream. The aftercooler(s) 154 may use any suitable form of coolant, such as for example water or air at ambient temperature.

The embodiment depicted in FIG. 1 can be readily applied to obtain a nitrogen-rich vapor product 139 that is suitable for use as a fuel gas, or that has a methane concentration of 10 mol % or less and is suitable for venting. The embodiment provides a method and apparatus that has a relatively low equipment count, is efficient, simple and easy to operate, and works well even with natural gas feed compositions of relatively low nitrogen concentration.

Referring now to FIGS. 2 to 6, these depict various further methods and apparatus for liquefying and removing nitrogen a natural gas stream according to alternative embodiments of the present invention.

Figure 2:
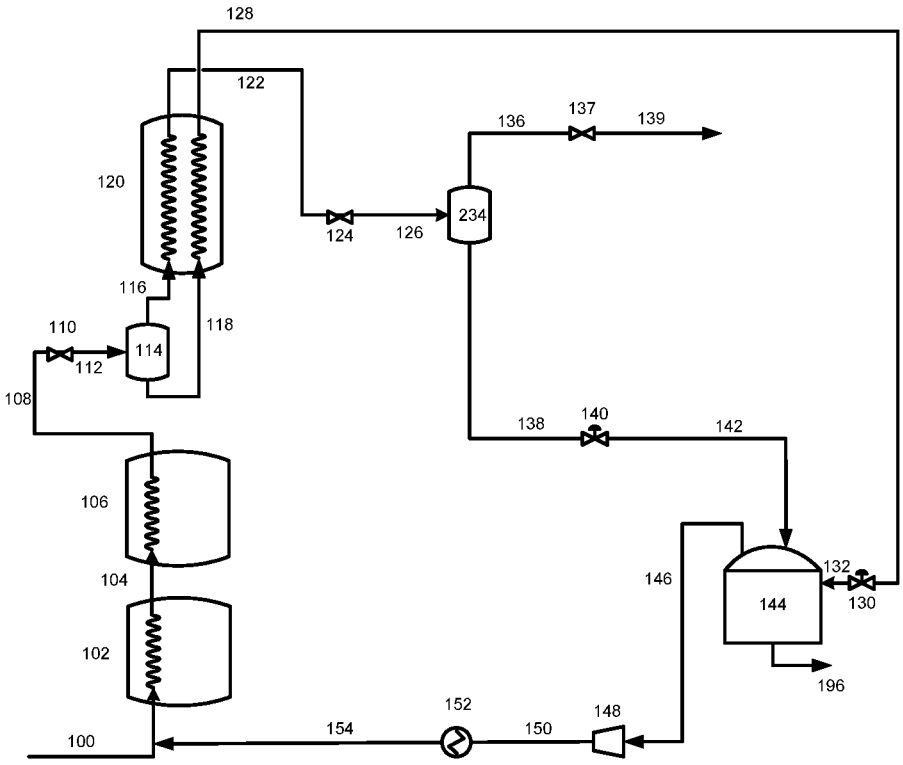
FIG. 2 is a schematic flow diagram depicting a method and apparatus according to another embodiment of the present invention.

The method and apparatus depicted in FIG. 2 differs from that depicted in FIG. 1 in that only the first at least partially liquefied nitrogen-enriched natural gas stream 122 (as opposed to both the first at least partially liquefied nitrogen-enriched natural gas stream 122 and the first LNG stream 128) is separated to form the nitrogen rich vapor product 136, 139 and second LNG stream 138, said separation taking place in a phase separator rather than in a distillation column, the first LNG stream 128 being sent to the LNG storage tank 144 alongside the second LNG stream 138.

More specifically, the first at least partially liquefied nitrogen-enriched natural gas stream 122 withdrawn from the cold end of the main heat exchanger is expanded and partially vaporized, by passing the stream through an expansion device such as for example a J-T valve 124 or turbo-expander (not shown), and separated in a phase separator (such as a flash drum) 234 into vapor and liquid phases forming, respectively, nitrogen rich vapor product 136, 139 and second LNG stream 138. The second LNG stream 138 is then expanded to form an expanded LNG stream 142 that is introduced into the LNG storage tank 144, as previously described. As before, the nitrogen-rich vapor product is enriched in nitrogen relative to the first at least partially liquefied nitrogen-enriched natural gas stream 122 and thus is further enriched in nitrogen relative to the natural gas feed stream 100.

The first LNG stream 128 withdrawn from the cold end of the main heat exchanger is expanded, by passing the stream through an expansion device such as a J-T valve 130 or turbo-expander (not shown), to form an expanded LNG stream 132 at approximately the same pressure as the expanded LNG stream 142 formed from the second LNG stream 138. The expanded first LNG stream 132 is likewise introduced into the LNG storage tank 144 in which, as described above, a portion of the LNG vaporizes, providing nitrogen enriched natural gas vapor that is withdrawn from the headspace of the tank as recycle stream 146, and leaving behind a nitrogen-depleted LNG product that is stored in the tank and can be withdrawn as LNG product stream 196. In this way, the first LNG stream 128 and the second LNG stream 138 are expanded, combined and together separated into the recycle stream 146 and the LNG product 196. However, in an alternative embodiment (not depicted), the first LNG stream 128 and the second LNG stream 138 could be expanded and introduced into different LNG storage tanks (or other forms of separation system) to produce separate recycle streams that are then combined, and separate LNG product streams. Equally, in yet another embodiment (not depicted), the first LNG stream 128 and the second LNG stream 138 could (if of or adjusted to a similar pressure) be combined prior to being expanded through a J-T valve, turbo-expander or other form of expansion device, and then the combined expanded stream introduced into the LNG storage tank (or other form of separation system).

Figure 3:
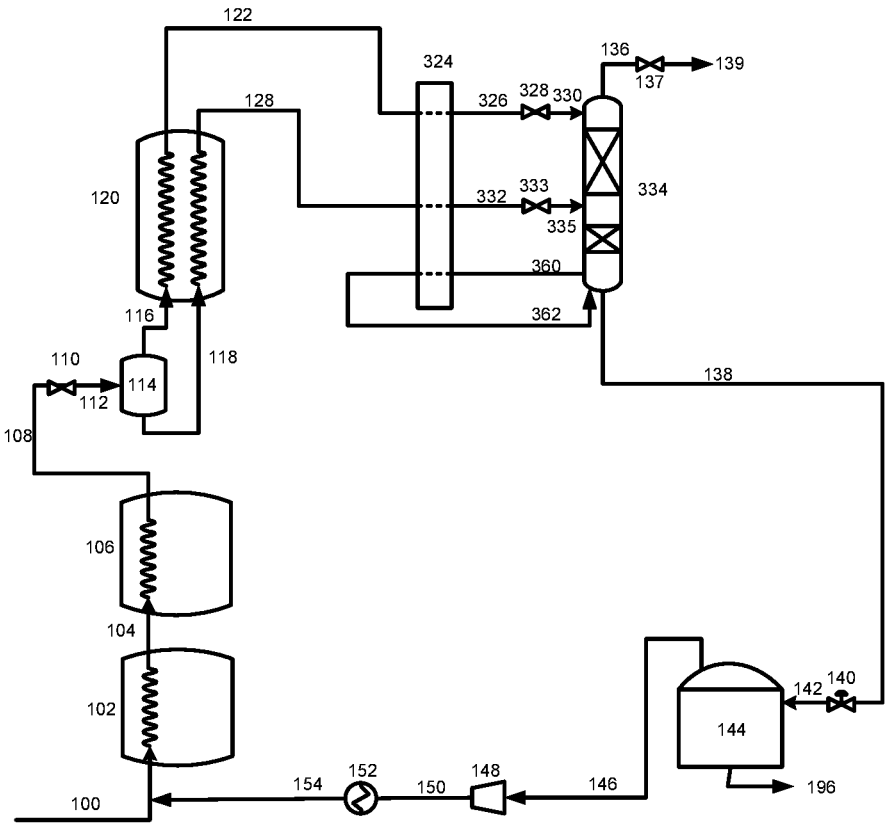
FIG. 3 is a schematic flow diagram depicting a method and apparatus according to another embodiment of the present invention.

The method and apparatus depicted in FIG. 3 differs from that depicted in FIG. 1 in that the distillation column 334 has two separation sections (each composed, as described above, of inserts such as packing and/or one or more trays), the first LNG stream 128 being separated in the distillation column into vapor and liquid phases by being introduced into an intermediate location of the distillation column 334, between the two separation sections. More specifically, the first LNG stream 128 withdrawn from the cold end of the main heat exchanger is cooled in a reboiler heat exchanger 324, expanded and partially vaporized, for example by being passed through an expansion device such as a J-T valve 333 or a turbo-expander (not shown), and is introduced as a partially vaporized stream 335 into the intermediate location of the distillation column 334. In this embodiment, the first at least partially liquefied nitrogen-enriched natural gas stream 122 is also cooled in reboiler heat exchanger 324 before being expanded and partially vaporized, for example by being passed through an expansion device such as a J-T valve 328 or a turbo-expander (not shown), and introduced as a partially vaporized stream 330 into the top of the distillation column 334, thereby providing reflux for the column. Boil-up for the distillation column 334 is provided by warming and at least partially vaporizing a stream 360 of bottoms liquid from the column in the reboiler heat exchanger 324 and returning the warmed and at least partially vaporized stream 362 to the bottom of the column thereby providing stripping gas to the column. The remainder of the bottoms liquid not vaporized in the reboiler heat exchanger is withdrawn from the bottom of the distillation column to form the second LNG stream 138.

Figure 4:
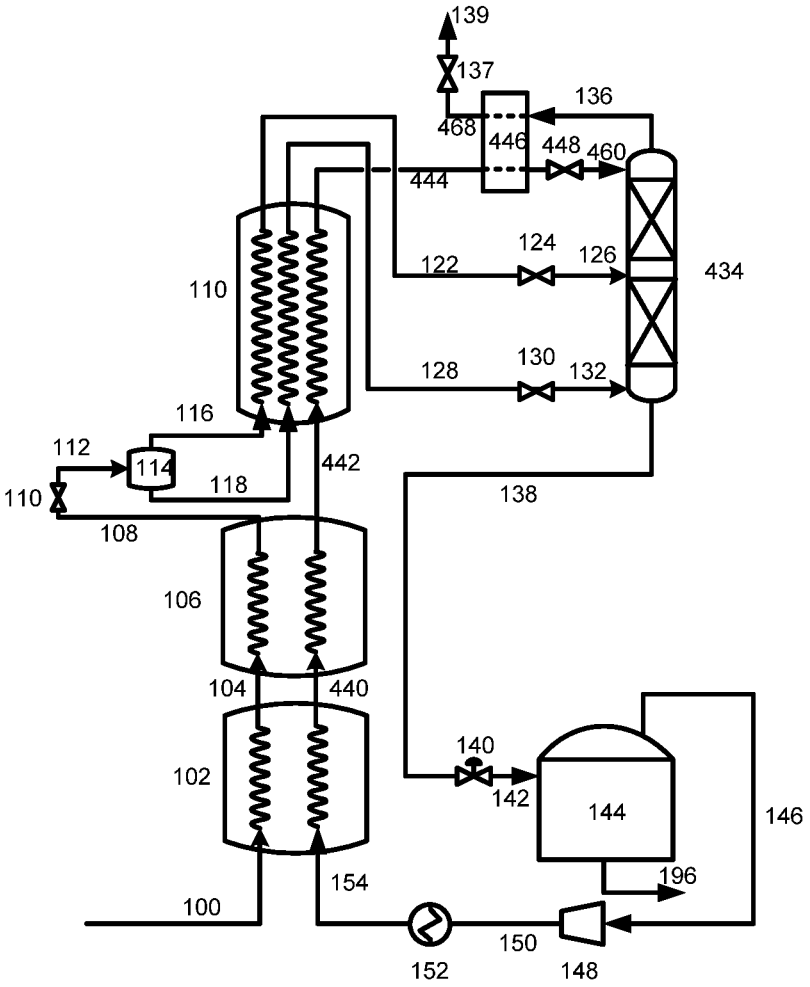
FIG. 4 is a schematic flow diagram depicting a method and apparatus according to another embodiment of the present invention.

The method and apparatus depicted in FIG. 4 differs from that depicted in FIG. 1 in that the compressed recycle stream 154 is not recycled to the main heat exchanger by being added to and mixed with the natural gas feed stream. Rather, the compressed recycle stream is introduced into and passed through (and cooled in) the main heat exchanger separately from and in parallel with the natural gas feed stream so as to form a second at least partially liquefied nitrogen-enriched natural gas stream 444. This stream is then withdrawn from the cold end of the main heat exchanger and, like the first at least partially liquefied nitrogen-enriched natural gas stream, is also introduced into the distillation column 434, which in this case comprises two separation sections, to be separated into vapor and liquid phases.

More specifically, the compressed recycle stream 154 exiting aftercooler 152 at approximately the same temperature (e.g. ambient) as the natural gas feed stream 100 is introduced into the warm end of the main heat exchanger separately from the natural gas feed stream and is passed through a fourth cooling passage that runs through the warm 102, middle 104 and cold 120 sections of the main heat exchanger separately from and in parallel with the first, second and third cooling passages, so that the compressed recycle stream 154 is cooled separately from and in parallel with the natural gas feed stream 100. The recycle stream is cooled and partially liquefied as it passes through the fourth cooling passage so as to form the second at least partially liquefied nitrogen-enriched natural gas stream 444, which is withdrawn from the cold end of the main heat exchanger.

The first LNG stream 128, first at least partially liquefied nitrogen-enriched natural gas stream 122 and second at least partially liquefied nitrogen-enriched natural gas stream 444, withdrawn from the cold end of the main heat exchanger, are then all sent to distillation column 434 to be separated into vapor and liquid phases. The distillation column 434 in this instance comprises, as noted above, two separation sections.

The first LNG stream 128 (which has the lowest nitrogen content of streams 128, 122 and 444) is expanded and partially vaporized, for example by being passed through an expansion device such as J-T valve 130 or a turbo-expander (not shown), and introduced as partially vaporized stream 132 into the bottom of the distillation column 434, thereby providing also stripping gas for the column. The first at least partially liquefied nitrogen-enriched natural gas stream 122 is expanded and partially vaporized, for example by being passed through an expansion device such as J-T valve 124 or a turbo-expander (not shown), and introduced as partially vaporized stream 126 into an intermediate location of the distillation column 434, between the two separation sections. The second at least partially liquefied nitrogen-enriched natural gas stream 444 (which has the highest nitrogen content of streams 128, 122 and 444) is cooled in a heat exchanger 446, expanded and partially vaporized, for example by being passed through an expansion device such as J-T valve 448 or a turbo-expander (not shown), and introduced as partially vaporized stream 460 into the top of the distillation column 434, thereby providing also reflux for the column. The nitrogen-depleted bottoms liquid is withdrawn from the bottom of the distillation column 434, forming the second LNG stream 138 which, as before, is expanded and introduced into the LNG storage tank 144. The overhead vapor withdrawn from the top of the distillation column again forms the nitrogen-rich vapor product stream 136, which in this case is warmed in heat exchanger 446 (via indirect heat exchange with the first at least partially liquefied nitrogen-enriched natural gas stream 444) to provide a warmed nitrogen-rich vapor product stream 139. In this embodiment, the nitrogen-rich vapor product stream 136, 139 obtained from the top of the distillation column can be an almost pure nitrogen vapor stream.

The use of the main heat exchanger to cool and at least partially liquefy the recycle stream, in parallel with but separately from the natural gas feed, provides distinct advantages. The recycle stream is enriched in nitrogen compared to the natural gas feed stream, and so liquefying or partially liquefying this stream separately from the natural gas feed and then separating the resulting at least partially condensed nitrogen-enriched stream provides for a more efficient process of separating the nitrogen and methane components of the recycle stream than if the recycle stream were to be recycled back into and separated together with the natural gas feed stream. Equally, whilst the recycle stream could be cooled and at least partially liquefied by adding a dedicated heat exchanger and refrigeration system for doing this, using the main heat exchanger and its associated existing refrigeration system to cool and at least partially liquefy the recycle stream, so that this can then be separated into the nitrogen rich product and additional LNG product, provides for a more compact and cost efficient process and apparatus.

It should also be noted that although, in the embodiment depicted in FIG. 4, the compressed recycle stream 154 is introduced into the warm end of the main heat exchanger, this need not necessarily be the case. In particular, if the compressed recycle stream is obtained at a temperature that is lower than the temperature of the natural gas feed stream, the compressed recycle stream may be introduced into at an intermediate location of the main heat exchanger at which the temperature of the compressed recycle stream better matches the temperature of the (now cooled) natural gas feed stream (the fourth cooling passage in this case then extending through the main heat exchanger from said intermediate location to the cold end of the main heat exchanger). For example, the compressed recycle stream could be introduced between the cold 102 and middle 106 sections, or between the middle 106 and cold 120 sections of the main heat exchanger. A compressed recycle stream 154 could be obtained at a colder temperature by, for example, further cooling the recycle stream 154 exiting aftercooler 152 in an economizer heat exchanger (not shown) against the recycle stream 146 exiting LNG storage tank 144 before the latter stream is compressed in compressor 148.

Figure 5:
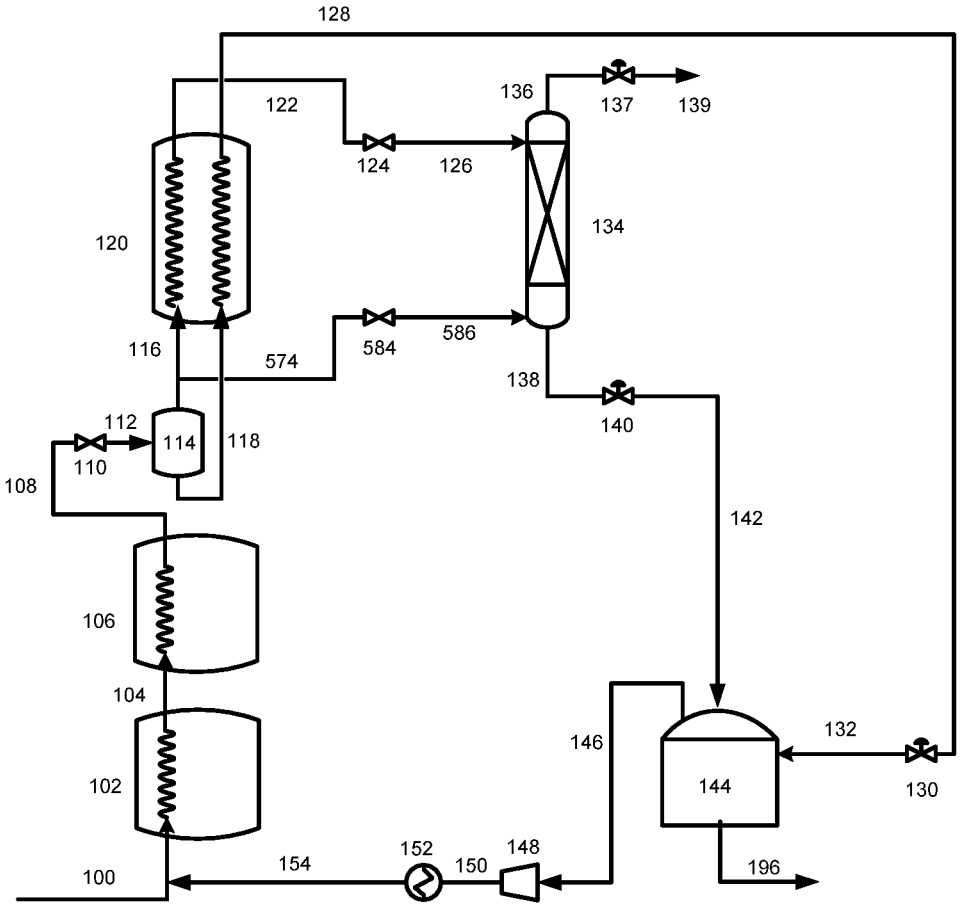
FIG. 5 is a schematic flow diagram depicting a method and apparatus according to another embodiment of the present invention.

The method and apparatus depicted in FIG. 5 differs from that depicted in FIG. 1 in that the first LNG stream 128 is not introduced into the distillation column 134 but is instead sent to the LNG storage tank 144 alongside the second LNG stream 138, and in that stripping gas for the distillation column is provided by a portion 574 of the nitrogen-enriched natural gas vapor obtained from phase separator 114.

More specifically, in the embodiment depicted in FIG. 5, the cooled and at least partially liquefied natural gas stream 108 withdrawn from an intermediate location of the main heat exchanger, between the middle and cold sections of the main heat exchanger, is (as previously described) expanded, partially vaporized an separated in a first separation system, composed of a expansion device, such as a J-T valve 110 or turbo-expander (not shown), and phase separator (such as a flash drum) 114, to form a nitrogen-enriched natural gas vapor and a nitrogen-depleted natural gas liquid. Also as previously described, the nitrogen-depleted natural gas liquid is withdrawn from the phase separator 114 as liquid stream 118 which is then further cooled in the cold section 120 of the main heat exchanger to form the first LNG stream 128. The nitrogen-enriched natural gas vapor that is withdrawn from the phase separator 114 is, however, in this embodiment divided so as to form two nitrogen-enriched natural gas vapor streams 116, 574. One vapor stream 116 is further cooled in the cold section 120 of the main heat exchanger to form the first at least partially liquefied nitrogen-enriched natural gas stream 122 as previously described. The other vapor stream 574 forms a stripping gas stream that is expanded, by passing the stream through an expansion device such as a J-T valve 584 or turbo-expander (not shown), and sent to the bottom of the distillation column 134, thereby providing stripping gas for said column. The first LNG stream 128 withdrawn from the cold end of the main heat exchanger is expanded, by passing the stream through an expansion device such as a J-T valve 130 or turbo-expander (not shown), to form an expanded LNG stream 132 at approximately the same pressure as the expanded LNG stream 142 formed from the second LNG stream 138, and that is likewise introduced into the LNG storage tank 144. In this regard, the first LNG stream 128 in this embodiment is used and processed in the same way as the first LNG stream 128 in the embodiment depicted in FIG. 2, described in further detail above.

Figure 6:
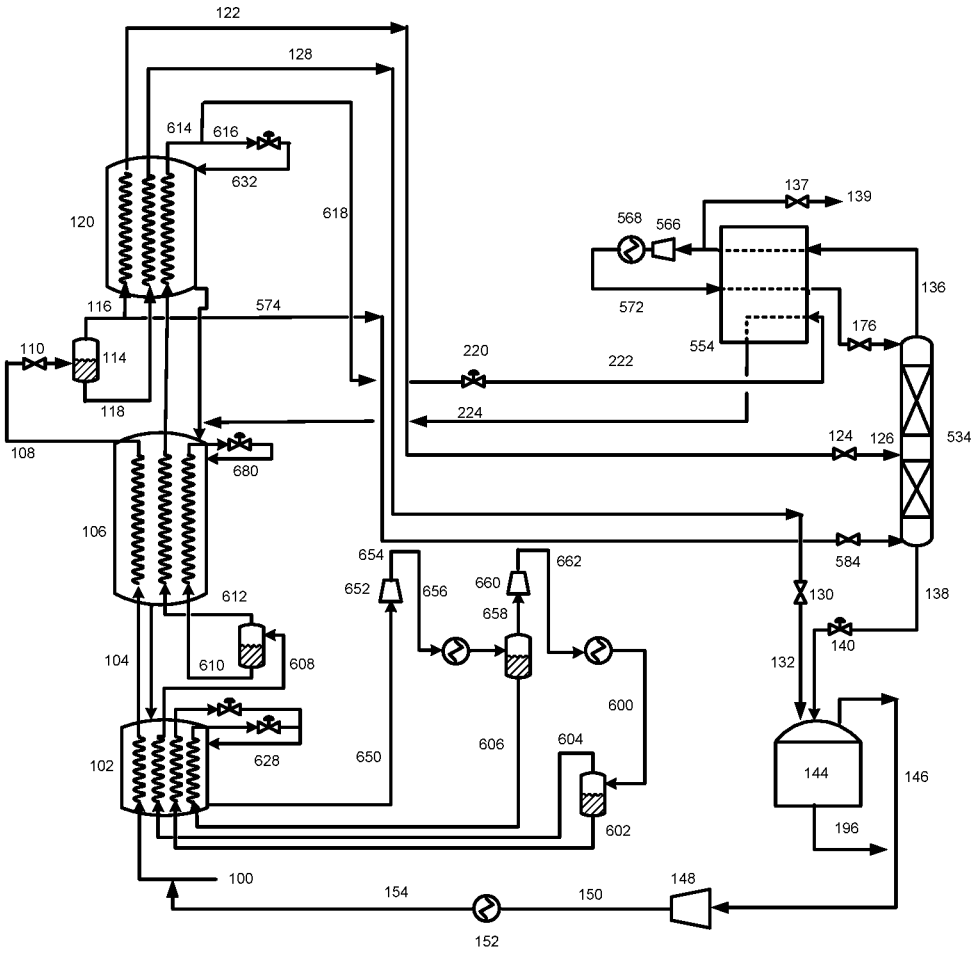
FIG. 6 is a schematic flow diagram depicting a method and apparatus according to another embodiment of the present invention.
Figure 7:
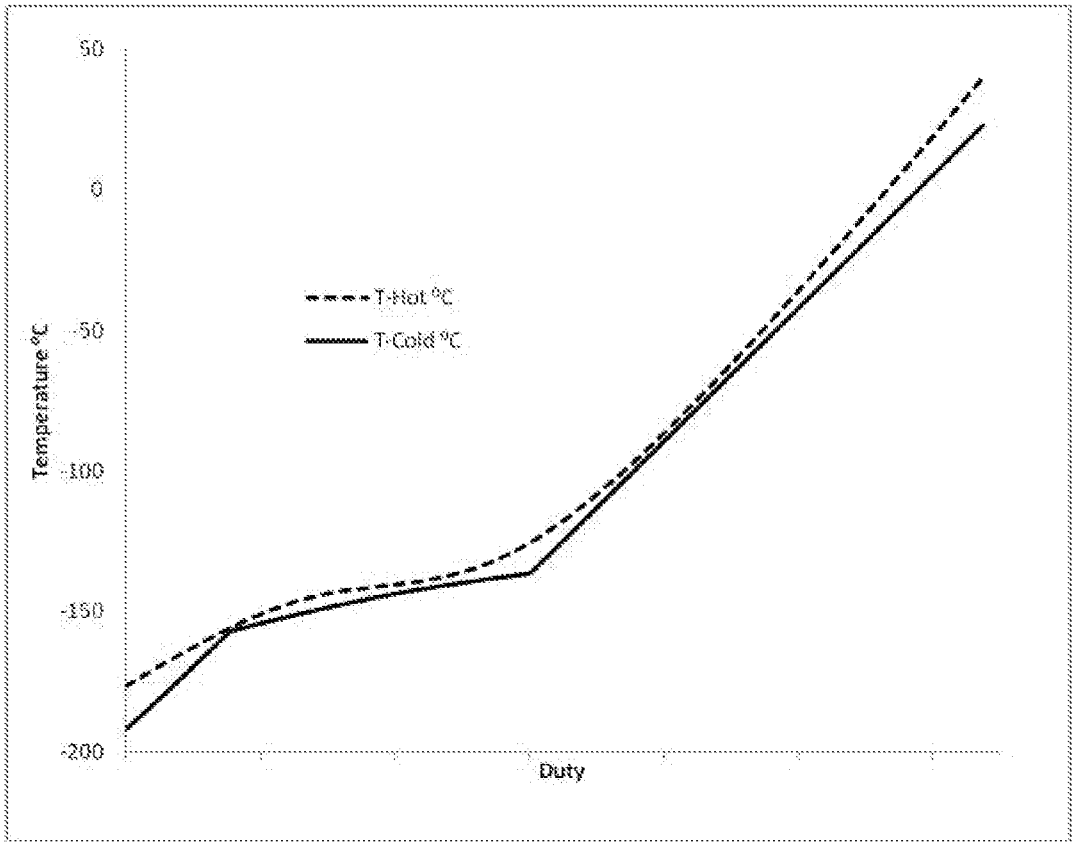
FIG. 7 is a graph showing the cooling curves for the condenser heat exchanger used in the method and apparatus depicted in FIG. 6.

The method and apparatus depicted in FIG. 6 differs from that depicted in FIG. 5 in that the distillation column 534 in this case has two separation sections, the first at least partially liquefied nitrogen-enriched natural gas stream 122 being introduced into the distillation column 534 between the two sections, and reflux for the distillation column 534 being provided by condensing a portion of the overhead vapor in a condenser heat exchanger 554. FIG. 6 also serves, more generally, to illustrate one possible closed loop refrigeration system that can be used to provide refrigeration to the main heat exchanger in any of the foregoing embodiments of the invention.

More specifically, in the embodiment depicted in FIG. 6, the first at least partially liquefied nitrogen-enriched natural gas stream 122 withdrawn from the cold end of the main heat exchanger is expanded and partially vaporized, for example by being passed through an expansion device such as J-T valve 124 or a turbo-expander (not shown), and introduced as partially vaporized stream 126 into an intermediate location of the distillation column 534, between the two separation sections, to be separated into vapor and liquid phases. Reflux for the distillation column 534 is provided by condensing a portion of the overhead vapor 136 from the distillation column in a condenser heat exchanger 554.

Refrigeration for the condenser heat exchanger 554 is in this embodiment provided in two different ways. Some of the refrigeration necessary for condensing a portion of the overhead vapor is provided by the cold overhead vapor itself. Some of the refrigeration is provided by a closed loop refrigeration system that is also providing refrigeration for the main heat exchanger.

More specifically, the overhead vapor 136 withdrawn from the top of the distillation column 534 is first warmed in condenser heat exchanger 554. A portion of the warmed overhead is then compressed in compressor 566, cooled in aftercooler 568 (using coolant such as, for example, air or water at ambient temperature), further cooled and at least partially liquefied in condenser heat exchanger 554, expanded, for example through a J-T valve 576, and returned to the top of distillation column 534 thereby providing reflux to the column. The remainder of the warmed overhead forms the nitrogen rich vapor product 139. Through the use of this nitrogen heat pump cycle (involving condenser heat exchanger 554, compressor 566, and aftercooler 568) to make the top of the distillation column 462 even colder, a nitrogen rich product 170 of even higher purity can be obtained.

Turning to the closed loop refrigeration system, refrigeration for the main heat exchanger may, for example, be provided by a single mixed refrigerant (SMR) system. In this type of closed loop system, the mixed refrigerant that is circulated consists of a mixture of components, such as a mixture of nitrogen, methane, ethane, propane, butane and isopentane. Also by way of illustration, each of cooling sections 102, 106 and 110 of the main heat exchanger is, in this example, a heat exchanger unit of the wound coil type. Warmed mixed refrigerant 650 exiting the warm end of the main heat exchanger is compressed in compressor 652 to form a compressed stream 656. The compressed stream is then passed through an aftercooler to cool and partly condense the stream, and is then separated in a phase separator into vapor 658 and liquid 606 streams. The vapor stream 658 is further compressed in compressor 660 and cooled and partly condensed to form a high pressure mixed refrigerant stream 600 at ambient temperature. The aftercoolers can use any suitable ambient heat sink, such as air, freshwater, seawater or water from an evaporative cooling tower.

The high pressure mixed refrigerant stream 600 is separated in a phase separator into vapor stream 604 and a liquid stream 602. Liquid streams 602 and 606 are then subcooled in the warm section 102 of the main heat exchanger, before being reduced in pressure and combined to form cold refrigerant stream 628 which is passed through the shell side of the warm section 102 of the main heat exchanger where it is vaporized and warmed to provide refrigeration to said section. Vapor stream 604 is cooled and partly liquefied in the warm section 102 of the main heat exchanger, exiting as stream 608. Stream 608 is then separated in a phase separator into vapor stream 612 and liquid stream 610. Liquid stream 610 is subcooled in the middle section 106 of the main heat exchanger, and then reduced in pressure form cold refrigerant stream 680 which is passed through the shell side of the middle section 106 of the main heat exchanger where it is vaporized and warmed to provide refrigeration to said section. Vapor stream 612 is condensed and subcooled in the middle 106 and cold 120 sections of the main heat exchanger exiting as stream 614. Stream 614 is expanded to provide at cold refrigerant stream 632, which is passed through the shell side of the cold section 120 of the main heat exchanger where it is vaporized and warmed to provide refrigeration to said section. The warmed refrigerant (derived from stream 632) exiting the shell side of cold section 120 is combined with refrigerant stream 680 in the shellside of the middle section 106, where it is further warmed and vaporized providing additional refrigerant to that section. The combined warmed refrigerant exiting the shell side of middle section 106 is combined with refrigerant stream 628 in the shell side of warm section 102, where it is further warmed and vaporized providing additional refrigerant to that section. The combined warmed refrigerant exiting the shell side of the warm section 102 has been fully vaporized and superheated by about 5° C., and exits as warmed mixed refrigerant stream 650 thus completing the refrigeration loop.

As noted above, in the embodiment depicted in FIG. 6 the closed loop refrigeration system also provides refrigeration for the condenser heat exchanger 554 that condenses a portion of the overhead vapor 136 from the distillation column 534 so as to provide reflux for said column. This is achieved by dividing the cooled mixed refrigerant exiting the main heat exchanger and sending a portion of said refrigerant to be warmed in the condenser heat exchanger 554 before being returned to and further warmed in the main heat exchanger. More specifically, mixed refrigerant steam 614 exiting the cold end of the main heat exchanger is divided into two portions, a minor portion 618 (typically less than 10%) and a major portion 616. The major portion is expanded to provide the cold refrigerant stream 632 that is used to provide refrigerant to the cold section 120 of the main heat exchanger, as described above. The minor portion 618 is expanded, for example by passing the stream through a J-T valve 220 another suitable form of expansion device (such as for example a turbo-expander), to form cold refrigerant stream 222. Stream 222 is then warmed and at least partly vaporized in the condenser heat exchanger 554, producing stream 224 that is then returned to the main heat exchanger by being combined with the warmed refrigerant (derived from stream 632) exiting the shell side of cold section 120 of the main heat exchanger and entering the shell side of the middle section 106 with refrigerant stream 680. Alternatively, stream 224 could also be directly mixed with stream 680 (not shown).

The use of the closed loop refrigeration system to provide also refrigeration for the condenser heat exchanger 554 improves the overall efficiency of the process by minimizing the internal temperature differences in the condenser exchanger 554, with the mixed refrigerant providing cooling at the appropriate temperature where the condensation of the recycled nitrogen is occurring. This is illustrated by the cooling curves depicted in FIG. 7 that are obtained for the condenser heat exchanger 554 when operated in accordance with the embodiment depicted in FIG. 6 and described above. Preferably, the discharge pressure of the compressor 566 is chosen such that the compressed and warmed portion of the overhead vapor 572 that is to be cooled in the condenser heat exchanger 554 condenses at a temperature just above the temperature at which the mixed refrigerant vaporizes. The overhead vapor 136 withdrawn from the distillation column 534 may enter the condenser heat exchanger 554 at its dew point (about −159° C.), and be warmed to near ambient condition. After withdrawal of the nitrogen-rich vapor product 139, the remaining overhead vapor is then compressed in compressor 566, cooled in aftercooler 568 to near ambient temperature and returned to the condenser heat exchanger 554 to be cooled and condensed, providing reflux for the distillation column 534, as previously described.

Example

In order to illustrate the operation of the invention, the process described and depicted in FIG. 1 was followed in order to obtain a nitrogen-rich vapor product stream with a flexible heating value and a liquefied natural gas product with only 1 mol % nitrogen. The feed gas composition was as shown in Table 1. The compositions of the primary streams is given in Table 2. The data was generated using ASPEN Plus software. As can be seen from the data in Table 2, the process is able to effectively remove nitrogen from liquefied natural gas stream and provide a sellable LNG product as well as a nitrogen stream that can be used as fuel gas.

TABLE 1

| Feed conditions and composition considered | |
|---|---|
| Temperature (° F.) | 91.4 |
| Pressure (psia) | 957 |
| Flowrate (lbmol/hr) | 4098 |
| Component (mol %) | |
| $N_2$ | 5.0 |
| $C_1$ | 92.0 |
| $C_2$ | 1.5 |
| $C_3$ | 1.0 |
| $nC_4$ | 0.40 |
| $nC_5$ | 0.10 |

TABLE 2

| Stream compositions | | | | | | |
|---|---|---|---|---|---|---|
| | 108 | 116 | 118 | 136 | 138 | 196 |
| Mole Fraction % | | | | | | |
| $N_2$ | 6.1 | 20.5 | 4.0 | 70.0 | 2.4 | 1.0 |
| C1 | 91.1 | 79.4 | 92.8 | 30.0 | 94.7 | 95.8 |
| C2 | 1.4 | 0.1 | 1.6 | 0 | 1.5 | 1.6 |
| C3 | 0.9 | 0 | 1.1 | 0 | 1.0 | 1.1 |
| nC4 | 0.4 | 0 | 0.4 | 0 | 0.4 | 0.4 |
| nC5 | 0.1 | 0 | 0.1 | 0 | 0.1 | 0.1 |
| Temperature ° F. | −165.8 | −184.6 | −184.6 | −277.8 | −263.9 | −261.1 |
| Pressure psia | 887.4 | 211.1 | 211.1 | 18.0 | 18.6 | 16.1 |
| Vapor Fraction | 0 | 1 | 0 | 1 | 0 | 0 |
| Total Flow lbmol/hr | 4391.0 | 568.6 | 3822.4 | 243.6 | 4147.3 | 3873.3 |

It will be appreciated that the invention is not restricted to the details described above with reference to the preferred embodiments but that numerous modifications and variations can be made without departing from the spirit or scope of the invention as defined in the following claims.

The invention claimed is:

1. A method for producing a nitrogen-depleted LNG product, the method comprising:

(a) introducing a natural gas feed stream into the warm end of a main heat exchanger, cooling and at least partially liquefying the natural gas feed stream, and withdrawing the cooled and at least partially liquefied stream from an intermediate location of the main heat exchanger;

(b) expanding, partially vaporizing and separating the cooled and at least partially liquefied stream to form a nitrogen-enriched natural gas vapor stream and a nitrogen-depleted natural gas liquid stream;

(c) withdrawing a portion of the nitrogen-enriched natural gas vapor stream to form a stripping gas stream;

(d) separately re-introducing a remaining portion of the nitrogen-enriched natural gas vapor stream and the nitrogen-depleted natural gas liquid stream into an intermediate location of the main heat exchanger to further cool the remaining portion of the nitrogen-enriched natural gas vapor stream and the nitrogen-depleted natural gas liquid stream in parallel, the remaining portion of the nitrogen-enriched natural gas vapor stream being further cooled and at least partially liquefied to form a first at least partially liquefied nitrogen-enriched natural gas stream and the nitrogen-depleted natural gas liquid stream being further cooled to form a first LNG stream, and withdrawing the first at least partially liquefied nitrogen-enriched natural gas stream and the first LNG stream from the cold end of the main heat exchanger;

(e) expanding and partially vaporizing the first at least partially liquefied nitrogen-enriched natural gas stream and introducing the expanded and partially vaporized stream into a distillation column to separate the expanded and partially vaporized stream to form a nitrogen-rich vapor product and a second LNG stream;

(f) introducing the stripping gas stream into the bottom of the distillation column;

(g) expanding, partially vaporizing and separating the second LNG stream and expanding, partially vaporizing and separating the first LNG stream to form a nitrogen-depleted LNG product from a liquid portion of said second LNG stream and first LNG stream and a nitrogen-enriched natural gas vapor from a vapor portion of said second LNG stream and first LNG stream, wherein said separation of the second LNG stream and separation of the first LNG stream take place in one or more LNG storage tanks or phase separators;

(h) withdrawing at least a portion of the nitrogen-enriched natural gas vapor as a recycle stream;

(i) compressing the recycle stream to form a compressed recycle stream; and (j) returning the compressed recycle stream to the main heat exchanger to be cooled and at least partially liquefied in combination with the natural gas feed stream.

2. The method of claim 1, wherein in step (b) the steps of expanding, partially vaporizing and separating the cooled and at least partially liquefied stream to form the nitrogen-enriched natural gas vapor stream and the nitrogen-depleted natural gas liquid stream comprise expanding and partially vaporizing the cooled and at least partially liquefied stream and separating said partially vaporized stream in a phase separator into vapor and liquid phases to form the nitrogen-enriched natural gas vapor stream and the nitrogen-depleted natural gas liquid stream.

3. The method of claim 1, wherein in step (g) the steps of expanding, partially vaporizing and separating the second LNG stream and expanding, partially vaporizing and separating the first LNG stream to form the nitrogen-depleted LNG product and the nitrogen-enriched natural gas vapor comprise expanding the second LNG stream, expanding the first LNG stream, and transferring both of said expanded second and first LNG streams into the same LNG storage tank, in which LNG storage tank a portion of the LNG present in each of said expanded second and first LNG streams vaporizes, thereby forming the nitrogen-enriched natural gas vapor and the nitrogen-depleted LNG product.

4. The method of claim 1, wherein the first at least partially liquefied nitrogen-enriched natural gas stream in step (e) is introduced into the top of the distillation column.

5. The method of claim 1, wherein refrigeration for the main heat exchanger is provided by a closed loop refrigeration system, refrigerant circulated by the closed loop refrigeration system passing through and being warmed in the main heat exchanger.

* * * * *